US012171259B2

(12) United States Patent
Williamson

(10) Patent No.: US 12,171,259 B2
(45) Date of Patent: Dec. 24, 2024

(54) COMBUSTIBLE SMOKING FILTER

(71) Applicant: Charles Williamson, Saginaw, MI (US)

(72) Inventor: Charles Williamson, Saginaw, MI (US)

( * ) Notice: Subject to any disclaimer, the term of this patent is extended or adjusted under 35 U.S.C. 154(b) by 285 days.

(21) Appl. No.: 17/378,021

(22) Filed: Jul. 16, 2021

(65) Prior Publication Data

US 2022/0160025 A1 May 26, 2022

Related U.S. Application Data

(60) Provisional application No. 63/053,073, filed on Jul. 17, 2020.

(51) Int. Cl.

| | |
|---|---|
| ***A24D 3/08*** | (2006.01) |
| ***A24D 1/18*** | (2006.01) |
| ***A24D 3/02*** | (2006.01) |
| ***A24D 3/06*** | (2006.01) |
| ***A24D 3/14*** | (2006.01) |
| ***A24F 1/02*** | (2006.01) |
| ***A24F 1/28*** | (2006.01) |
| ***A24F 1/30*** | (2006.01) |
| ***A24F 5/04*** | (2006.01) |

(52) U.S. Cl.

CPC ..... *A24D 3/08* (2013.01); *A24D 1/18* (2013.01); *A24D 3/0262* (2013.01); *A24D 3/062* (2013.01); *A24D 3/067* (2013.01); *A24D 3/14* (2013.01); *A24F 1/02* (2013.01); *A24F 1/28* (2013.01); *A24F 1/30* (2013.01); *A24F 5/04* (2013.01)

(58) Field of Classification Search

CPC ..... A24D 1/00; A24D 1/18; A24D 3/00; A24D 3/06; A24D 3/08; A24D 3/14; A24D 3/062; A24D 3/067; A24D 3/02; A24D 3/025; A24D 3/0262; A24F 1/00; A24F 1/02; A24F 1/28; A24F 1/30; A24F 5/00; A24F 5/04

See application file for complete search history.

(56) References Cited

U.S. PATENT DOCUMENTS

| | | | | | |
|---|---|---|---|---|---|
| 1,004,322 | A | | 9/1911 | Westcott | |
| 1,127,771 | A | | 2/1915 | Jones | |
| 1,165,000 | A | * | 12/1915 | Dula | |
| 1,221,864 | A | * | 4/1917 | Irving | |
| 1,572,342 | A | | 2/1926 | Wiltsey | |
| 1,606,607 | A | | 11/1926 | Varley | |
| 2,129,129 | A | | 9/1938 | Groulx | |
| 2,937,648 | A | | 5/1960 | Meyer | |
| 2021/0045432 | A1 | * | 2/2021 | Ristevski | A24D 1/002 |
| 2021/0213091 | A1 | * | 7/2021 | Docherty | A61K 36/81 |

* cited by examiner

*Primary Examiner* — Christopher M Rodd
*Assistant Examiner* — Daniel Edward Vakili
(74) *Attorney, Agent, or Firm* — University of Detroit Mercy School of Law International IP Clinic

(57) ABSTRACT

An article for use with a smoking device that is configured to be insertable into a chamber defined in the smoking device. The article includes an air-permeable filter member that comprises plant-based material that permits a user to combust a smoking device's contents. Upon combustion of a smoking device's contents, the combustible smoking filter may also combust and be smoked.

19 Claims, 7 Drawing Sheets

COMBUSTIBLE SMOKING FILTER

CROSS-REFERENCE TO RELATED APPLICATION(S)

This application claims priority to and the benefit of U.S. Provisional Application Patent Ser. No. 63/053,073, filed Jul. 17, 2020, the entire disclosure of which is hereby incorporated by reference.

TECHNICAL FIELD

This disclosure relates generally to smoking devices, specifically a combustible smoking filter that may incorporate into a smoking device.

BACKGROUND

Pipe smoking filters are generally composed of a non-combustible material. While cigarette filters often incorporate cotton or other fibrous, combustible materials, pipe smoking filters are generally composed of metal, glass, or ceramic material. Typically, pipe smoking filters prevent particulates from entering the mouthpiece of a smoking device while remaining permeable to air. In order to filter particulate matter, composite smoking filters tend to not be combustible. As a result, many smoking devices clog with ash or resin, reducing airflow through the smoking device. Such a reduction in airflow reduces the quality of the smoke, thus requiring cleaning of the filter and smoking device after repeated use. Filters are often replaced when clogged.

Information relevant in addressing these problems can be found in patents such as U.S. Pat. No. 2,129,129 A (Groulx, 1937). However, such references are not manufactured from combustible materials so they are not combusted along with the smoked substance.

For the foregoing reasons, there is a need for a smoking filter that permits airflow while being combustible.

SUMMARY

An article for use with a smoking device that is configured to be insertable into a chamber defined in the smoking device is disclosed. The filter member composed of at least one combustible plant-based material compressed into an air-permeable geometric shape, wherein the filter member has a first face, a second face opposed to the first face and at least one wall surface interposed between the first face and the second face.

Also disclosed is a smoking device that includes a bowl, a mouthpiece in fluid communication with the draught hole draught hole defined in the bowl and a filter member insertably positioned in the bowl at a location between the at one opening and the draught hole in spaced relationship thereto, the filter member having at least one combustible plant-based material. The filter member has combustible plant material compressed into an air-permeable geometric shape that has a first face, a second face opposed to the first face and at least one wall member interposed between the first face and the second face.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1A:
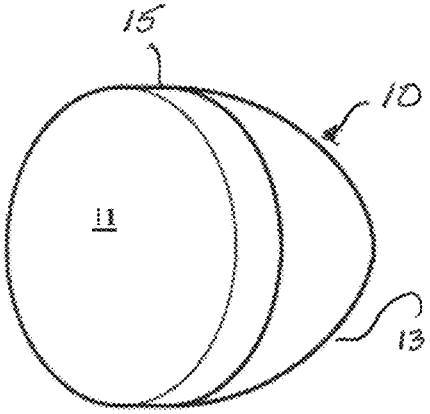
FIG. 1A is a depiction of an example configuration of the filter member as disclosed herein.
Figure 1B:
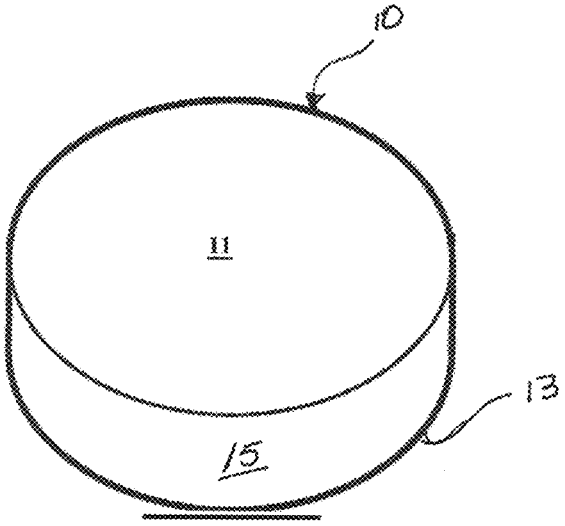
FIG. 1B is a depiction of an example configuration of the filter member as disclosed herein.
Figure 1C:
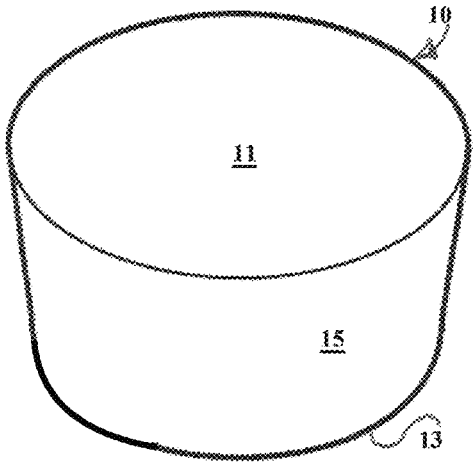
FIG. 1C is a depiction of an example configuration of the filter member as disclosed herein.
Figure 1D:
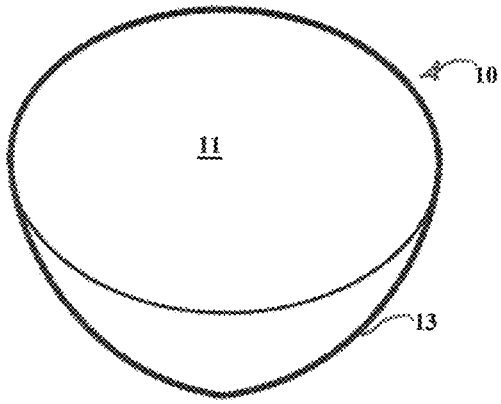
FIG. 1D is a depiction of an example configuration of the filter member as disclosed herein.
Figure 1E:
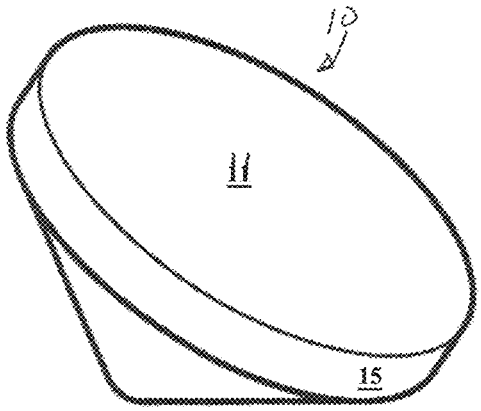
FIG. 1E is a depiction of an example configuration of the filter member as disclosed herein.

Disclosed herein is an article for use with a smoking device that includes a filter member 10 that is configured to be insertable into a chamber 12 that is defined in the associated smoking device 22. The filter member 10 is composed of at least one combustible plant-based material compressed into an air-permeable geometric shape. The filter member 10 can have a first face 11, a second face 13 opposed to the first face 11 and at least one wall surface 15 interposed between the first face 11 and the second face 13.

The chamber 12 that is defined in the associated smoking device 22 can be one having an inner wall surface 23 with at least one open end defined in the inner wall surface 23 and at least one draught hole 16 defined in the inner wall surface 23 at a location opposed to the open end. The filter member 10 disclosed herein is configured to contact the inner wall surface 23 and to be positioned between the at least one open end and the draught hole 16 in spaced relation to both.

As broadly construed, the present disclosure is directed to an article for use with a smoking device as well as smoking devices that include the article therein. The article as disclosed is a filter member 10 that is configured to be insertable into at least one chamber 12 defined in a suitable smoking device such as smoking device 22. The filter member 10 is composed of at least one combustible plant-based material 28 compressed into a suitable air-permeable geometric shape such as those depicted in FIGS. 1A-1F. In certain embodiments, the filter member 10 as disclosed herein can include a first face 11, a second face 13 opposed to the first face 11 and at least one wall surface 15 interposed between the first face 11 and the second face 13. Where desired or required, the first face 11 of the filter member 10 can be oriented so that the first face 11 is positioned facing the opening defined in the associated smoking device and the opposed second face 13 is positioned to face the draught hole when the filter member 10 is in the use position. In certain embodiments at least one of the first face 11 and the second opposed face 13 of the filter member 10 is concave. One non-limiting example of concavity is illustrated in FIG. 1F which depicts concavities in both the first illustrate concavities in the first face 11 and the second face 13.

Figure 5A:
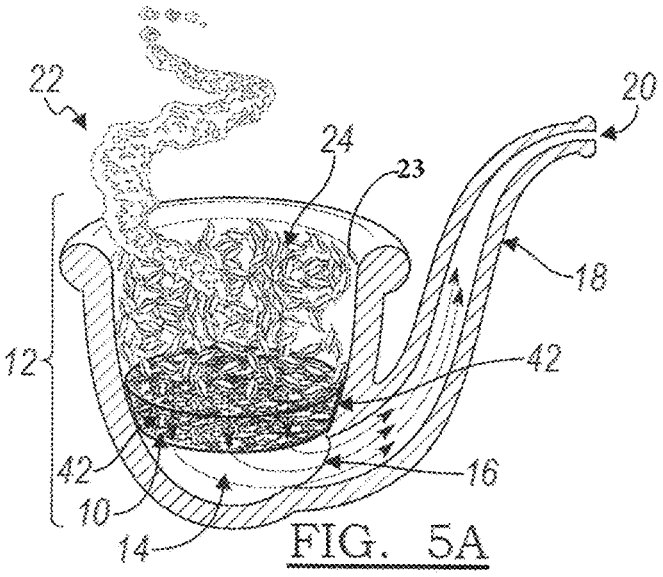
FIG. 5A is a cross-section of an embodiment of a smoking device as disclosed herein in the use position.

Given its air-permeable and combustible characteristics, the filter member 10 as disclosed herein permits a user to combust a primary smoking material 24 introduced into the smoking device 22 without impairment. The primary smoking material 24 can be introduced in a manner that overlays the first face 11 of the filter member 10 as illustrated in FIG. 5A if desired or required. As the combustion of the primary smoking material 24 present in the smoking device 22 nears complete combustion, the combustible filter material present in filter member 10 itself combusts and is smoked. Accordingly, the filter member 10 permits air flow through the smoking device 22 while also preventing primary smoking material 24 or debris produced during the combustion of the primary smoking material 24 from falling further into the smoking device 22. By doing so, the combustible filter member 10 avoids obstructions caused by debris and residue caused by the partial combustion of the primary smoking material 24 and resin produced by the combustion, thereby contributing to better airflow and a higher quality smoking experience.

Suitable smoking devices 22 generally include a chamber 12 or bowl having a draught hole 16 defined therein and a stem 18 in fluid communication with the chamber 12 or a suitable intermediate chamber via the drought hole 16. The smoke created in a smoking device 22 passes through the draught hole 16, into the stem 18 or other intermediate chamber, and then into the mouthpiece 20 from which the smoke is inhaled.

The filter member 10 as disclosed herein includes at least one combustible plant-based material that is compressed into an air-permeable geometric shape. When positioned in the chamber 12 of the suitable smoking device 22, the filter member 10 defines an air pocket 14 located between the filter member 10 and the draught hole 16 defined in the chamber 12. In certain embodiments, the air pocket 14 is located between the lower or second face 13 of the filter member 10 and the region of the chamber 12 that include and is proximate to the draught hole 16 such as the configuration illustrated in FIGS. 5A-8. The air pocket 14 provides more oxygen to the combustion of the primary smoking material 24, which results in a higher quality smoke. This also leads to the primary smoking material 24 combusting longer, which requires less relighting during a smoking session.

Figure 7:
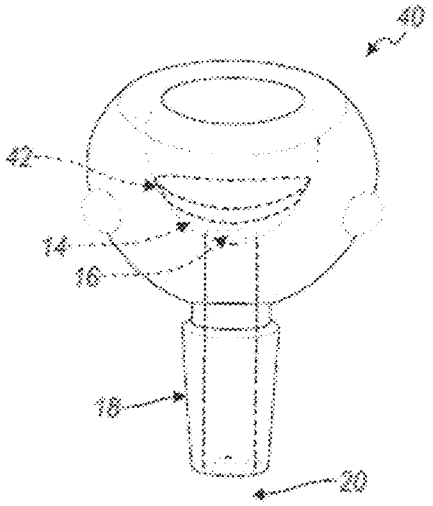
FIG. 7 is a perspective view of a second alternate embodiment of the smoking device as disclosed herein.
Figure 8:
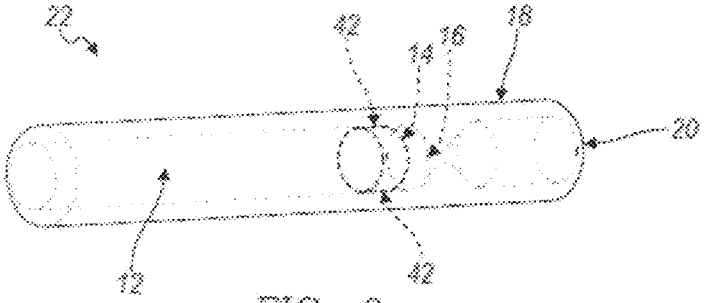
FIG. 8 is a perspective view of a third embodiment of the smoking device as disclosed herein.

The filter member 10 is configured to seat in the chamber 12 defined in a suitable smoking device 22. As broadly construed, suitable smoking devices 22 are those having a chamber 12 into which the filter member 10 can be inserted and form an air pocket 14 between the filter member 10 and the exit orifice or draught hole 16 of the smoking device 22. Non-limiting examples of suitable smoking devices include tobacco pipes such as the one depicted in FIGS. 4, 5A and 5B, chillum pipes 38 such depicted in FIG. 8, water pipes, or various smoking devices configured with a detachable bowl as depicted in FIG. 7, with an air pocket 14 forming between the filter member 10 and the draught hole 16 or other suitable exit orifice defined in smoking device 22.

Figure 1F:
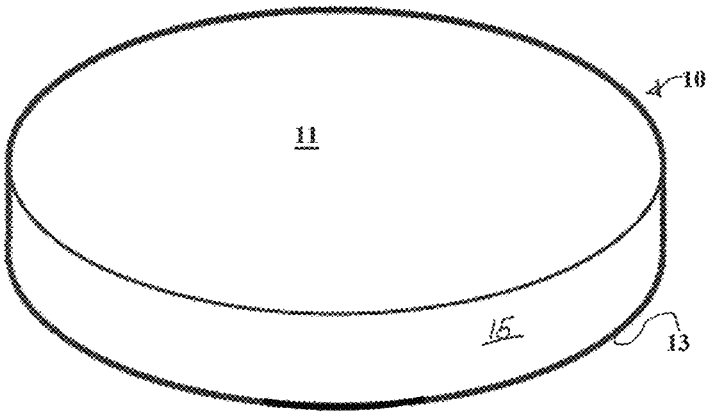
FIG. 1F is a depiction of an example configuration of the filter member as disclosed herein.

As shown in FIGS. 1A-IF, the filter member 10 can have a variety of shapes. Such shapes include, but are not limited to, disc-shaped, polygonal, octagonal, spherical, cuboidal, cylindrical, ellipsoidal, tetrahedronal, or spheroidal. The shapes of the filter member 10 are not limited to these examples and can comprise any polyhedron. In certain embodiments, at least one of the first face 11 and the second face 13 of the filter member 10 can be concave.

In one embodiment, the combustible smoking filter member 10 may comprise a center portion 32 and a perimeter portion 34, wherein the center portion 32 of the filter member 10 is thicker than the perimeter portion 34 so that the filter member 10 better fits into place in the chamber 12 of a smoking device 22. Additionally, the filter member 10 can be scaled up and down in size to fit a variety of smoking devices 22. For instance, in a disc-shaped embodiment, the diameter can be as little as 5 millimeters and as large as 100 millimeters. At smaller diameters, the disc-shaped embodiment of the filter member 10 can fit into relatively small smoking devices 22, such as pipes, chillum pipes 38, or detachable bowls 40. At larger diameters, the filter member 10 can fit into larger smoking devices 22 such as a hookah pipe and the like. In certain embodiments, the filter member 10 can weigh as little as 1 gram to as much as 10 grams, depending on its size and shape. Regardless of the prescribed shape of the filter member 10, the shape can be expanded and molded to fit variably sized smoking devices 22.

In certain embodiments, the filter member 10 is composed of at least one plant-based material 28 will have a configuration, size and weight suitable to be insertable into at least one chamber 12 or bowl defined in the smoking device 22. Chamber 12 can be the area into which primary smoking material such as primary smoking material 24 is inserted during general use. It is contemplated that, in certain embodiments, the filter member 10 will be interposed between at least one primary smoking material 24 and the draught hole 16 or exit orifice through which smoke is inhaled.

Depending on the size of the chamber 12 or bowl of the smoking device 22, the filter member 10 as disclosed can be configured to seat in the chamber. In certain embodiments, it is contemplated that the filter member 10 can have an outer perimeter that is between 5 millimeters and 100 millimeters. The filter member 10 can be of any suitable geometric shape. In many embodiments, the shape of the filter member 10 will conform to a portion of the inner contour of the inner wall surface 23 of chamber 12. In many embodiments, the filter member 10 can be disc-shaped. Other non-limiting examples of suitable configurations are depicted in FIGS. 1A-1F.

The plant-based material 28 present in the filter member 10 can include one or more plant materials that can be used to prepare a non-reusable, disposable, biodegradable, or filter member 10 as desired or required. Suitable plant-based material can include, but is not limited to, hemp, tobacco, sage, marijuana, *salvia* divinorum. It is also contemplated that the plant materials can be fortified with one or more compounds such as synthetic cannabinoids. It also is contemplated that various plant-based materials can be include materials that may create the potential for different flavors upon its combustion, any one of which may signal to a user that the primary smoking material 24 in smoking device 22 is near full combustion. Where desired or required, it is contemplated that the user may not need to actively combust or light the filter member 10, as the ignited the primary smoking material 24, upon combustion, may proceed to passively ignite and combust the filter member 10.

When placed into the smoking device 22, the filter member 10 creates the air pocket 14 that separates the filter member 10 and the draught hole 16 of the smoking device 22, allowing better air flow and a higher quality smoking experience for a user. As the primary smoking material 24 nears complete combustion, the filter member 10 composed of plant-based material itself combust and be smoked. When the filter member 10 composed of plant-based material completes combustion, the resin and plant material residue are eliminated from the smoking device 22. The filter member 10 composed of plant-based material thus keeps the smoking device 22 clean by preventing resin and primary smoking material 24 from falling into the region of the smoking device 22 proximate to the draught hole 16 while still providing sufficient air flow through the smoking device 22.

Figure 3:
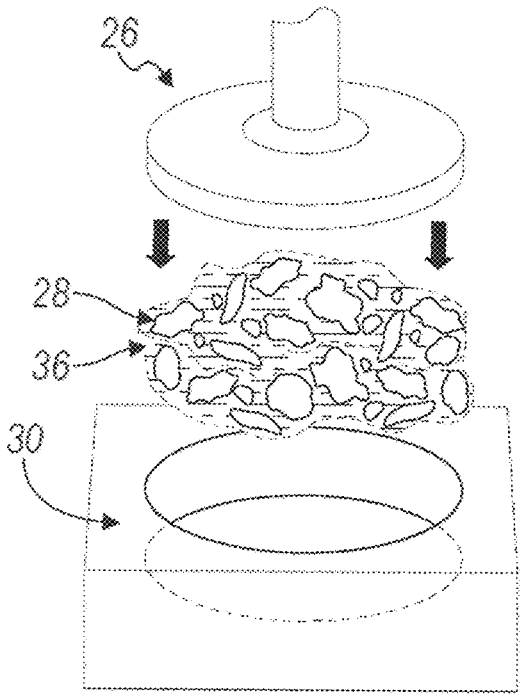
FIG. 3 is a schematic embodiment of a method of manufacture of an embodiment of the filter member as disclosed herein using plant material, a distillate material, and a press.

As shown in FIG. 3, the filter member 10 may be made by condensing loose, moist plant-based material 28 into a cohesive geometric member. Where desired or required, the plant-based material can be admixed with a suitable distillate material 36 which may be function as a binder or adhesive. In certain embodiments, distillate material 36 can be an organic distillate material such as cannabidiol (CDB) oil or any non-toxic, oleaginous substance. Loose, moist plant-based material 28, such as hemp, marijuana, tobacco, or sage or the like may be mixed together with the distillate material 36 and shaped by a mold 30 to the desired shape or shapes. If the plant-based material is dry, the filter member 10 can still be made by using more distillate material 36. If no distillate 36 is used to adhere the plant-based material 28 together, additional pressure may be necessary to condense the dry plant-based material 28 and create the filter member 10.

In certain embodiments, the plant-based material 28 may be admixed together with an optional distillate material 36. The material can be shaped by a hand-rosin or mechanical press 26 if desired or required. The article 10 with the associated filter member 11 may be pressed into a variety of polyhedronal shapes to fit differently sized chambers or bowls in different smoking devices 22. Once placed into the mold 30, a mechanical or hand rosin press 26 may apply pressure to condense and compact the plant-based material 28 into a hard, compacted, filter member 10 that is still permeable to air. Once removed from the mold 30, the filter member 10 may be introduced into a smoking device 22.

In certain embodiments, the filter member 10 may be used with a variety of smoking devices 22, including pipes, chillum pipes 38, water pipes, hookah pipes, and various smoking devices 22 that use detachable bowls 40 such as bongs. When in use, the filter member 10 may seat in the chamber 12 such as bowl defined in the smoking device 22, at a position between the primary smoking material 24 and the draught hole 16. When a user ignites the primary smoking material 24 and draws on the mouthpiece 20, the primary smoking material 24 in the smoking device 22 may combust and create smoke, which can pass filter member 10, air pocket 14, draught hole 16, stem 18, and finally into the mouthpiece 20. The filter member 10 can prevent debris from falling into the air pocket 14 or being drawn into the draught hole 16, which otherwise may create occlusions that prevent combustion or a user's ability to use the smoking device 12. As the primary smoking material 24 nears complete combustion, the filter member 10 itself can combust and produce smoke, which then can pass through the draught hole 16, stem 18, and mouthpiece 20 and be inhaled by the user.

In use, a user can put insert the filter member 10 in the chamber 12 or bowl of a smoking device 22, load the smoking device 22 with the primary smoking material 24, and then proceed to smoke the primary smoking material 24. Alternately, the filter member 10 can be configured such that the filter member 10 has a portion of primary smoking material 24 adhered thereto as a single unit.

In either configuration, once the primary smoking material 24 has neared full combustion, the filter member 10 can combust and be smoked. Typically, the filter member 10 can be oriented toward the bottom of the chamber 12 or bowl of the smoking device 22, while the primary smoking material 24 sits on top of the filter member 10. The primary smoking material 24 may be any organic or botanical substance, including but not limited to tobacco, hemp, sage, marijuana, *salvia* divinorum, or synthetic cannabinoids. By using a filter member 10 composed of a material different from the primary smoking material 24, a user may be alerted of the approach of full combustion of the primary smoking material 24 by detecting a different flavor as a signal.

The filter member 10 may be used in almost any smoking device 22 that contains a bowl that defines chamber 12 and a draught hole 16, including pipes, chillum pipes 38, water pipes, or smoking devices 22 that use detachable bowls 40 such as bongs. The filter member 10 may rest close to the draught hole 16 and leave an air pocket 14 between the filter member 10 and the draught hole 16 at the bottom of the chamber 12. The air pocket 14 may form at the outermost junction of the combustible smoking filter member's seat 42 with the smoking device 22.

Additionally, the air pocket 14 may also form in the space between the draught hole 16 of the smoking device 22 and the filter member 10. Otherwise, the air pocket 14 may be in fluid communication with the draught hole 16 of the smoking device 22 and the combustible smoking filter's seat 42 within the chamber 12 defined in the bowl of the smoking device 22.

Figure 2A:
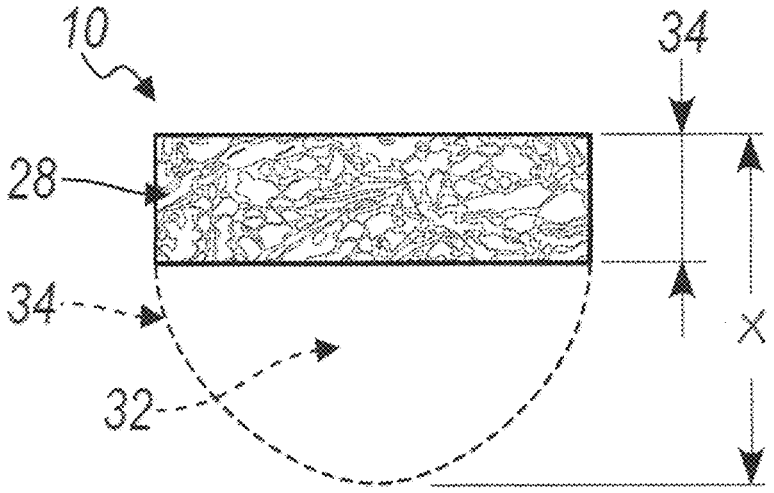
FIG. 2A is a side view of a first embodiment of the filter device as disclosed herein.
Figure 2B:
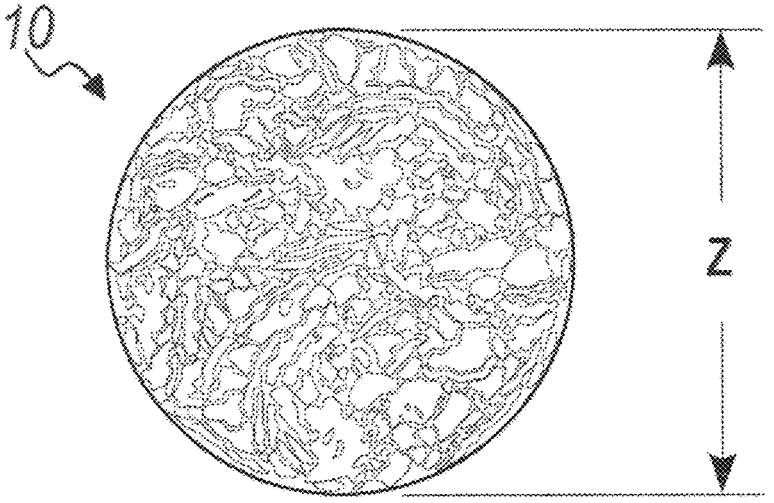
FIG. 2B is a top view the filter device of FIG. 2A.

As shown in FIG. 1, one embodiment of the filter member 10 as disclosed may be a disc that weighs less than 1 gram and is approximately 13.6 millimeters in diameter. The disc-shaped filter member 10 may be thicker in its center portion 32 than it is at the perimeter portion 34, with the perimeter position 34 having a thickness y as depicted in FIGS. 2A and 2B. The filter member 10 may comprise a combination of, or merely consist of, hemp, marijuana, tobacco, sage, or *salvia* that may be adhered together with a distillate material 36. The filter member 10 is usable in almost any smoking device 22 that tapers down to a draught hole 16, including pipes, water pipes, chillum pipes 38, and smoking devices 22 that use detachable bowls 40. The filter member 10 rests close to the draught hole 16 while leaving an air pocket 14 between the filter member 10 and the draught hole 16 of the smoking device 22.

As shown in FIG. 2, the dimensions (y&z) of the filter member 10 may be such that the filter member 10 fits in the bottom region of a chamber 12 defined in the bowl of a smoking device 22 such that an air pocket 14 is defined in the bowl of the smoking device 22 in the region between the inserted filter member 10 and the draught hole 16 defined in the bowl. As illustrated in FIG. 2A, the first surface of the filter member 10 is disposed at a distance x from the base of the air chamber 14 when the filter member 10 is in position in the associated bowl.

As shown in FIG. 3, the filter member 10 may be made by compressing the plant-based material 28 and optionally a distillate material 36 in a mold 30 with a hand-rosin or mechanical press 26.

Figure 4:
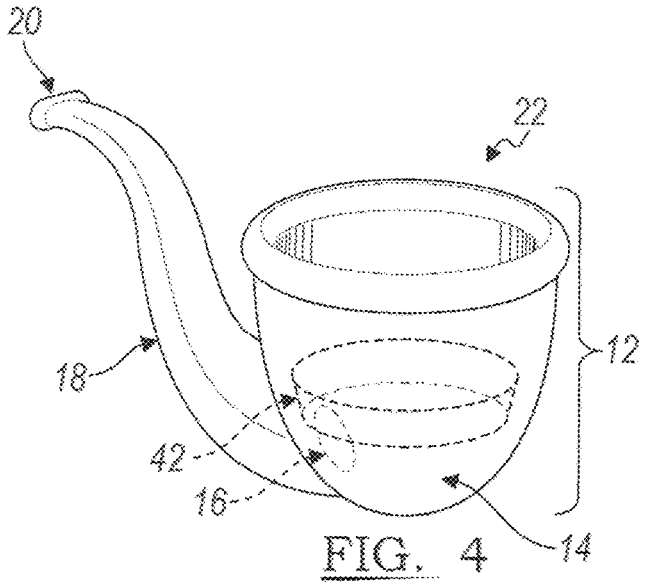
FIG. 4 is a representative embodiment of a smoking device having a seating region for the filter device as disclosed herein.

As shown in FIG. 4, the filter member 10 may fit in the bottom of a smoking device 22 such as a traditional tobacco pipe while leaving an air pocket 14 between filter member 10 and the draught hole 16 of the smoking device 22.

As shown in FIG. 5A, one embodiment as disclosed herein comprises a filter member 10 seated in the chamber 12 defined in the bowl of the smoking device 22. The filter member 10 seats just above the smoking draught hole 16 of smoking device 22, creating an air pocket 14 between the filter member 10 and the draught hole 16 of the smoking device 22. Positioned on top of the filter member 10 is the primary smoking material 24. As the primary smoking material 24 combusts, smoke passes down through the filter member 10, into the air pocket 14, through the draught hole 16, out through the stem 18 of smoking device 22, and then into the mouthpiece 20. The filter member 10 prevents the pieces of primary smoking material 24 from falling into the lower portions of the smoking device 22 for the duration of the combustion.

Figure 5B:
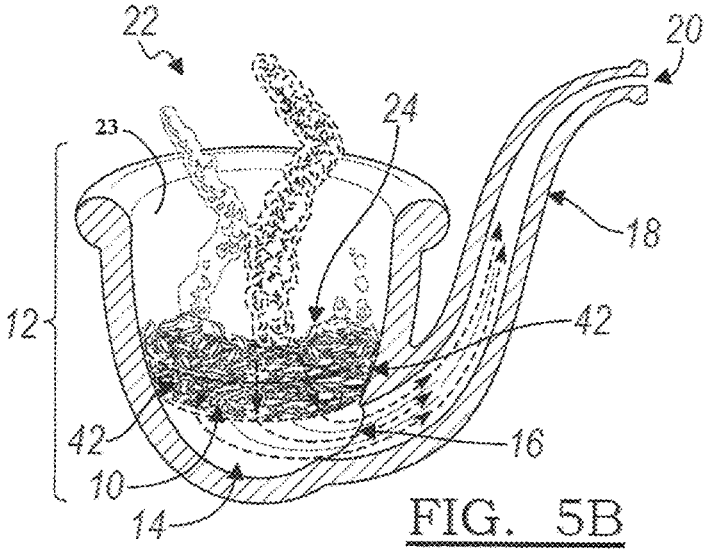
FIG. 5B is a cross-section of the embodiment of FIG. 5A at a later point in a representative use interval.
Figure 6:
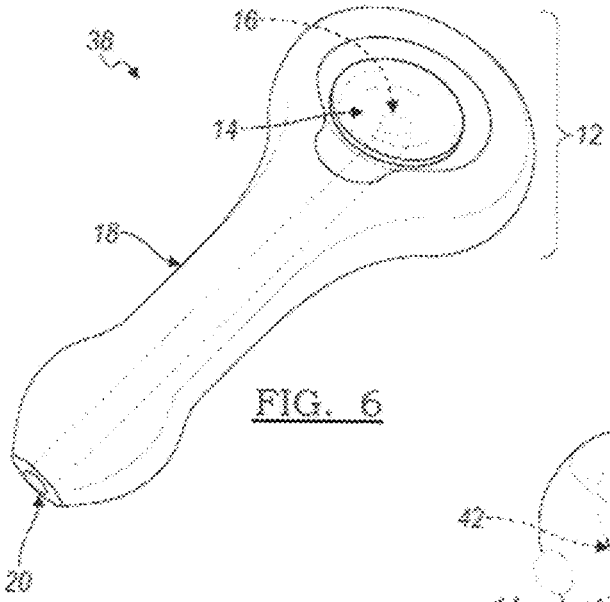
FIG. 6 is a perspective view of a first alternate embodiment of the smoking device as disclosed herein.

As shown in FIG. 5B, as the primary smoking material 24 present in the smoking device 22 nears or completes full combustion, the filter member 10 combusts and can be smoked. In combusting itself, the filter member 10 may prevent occlusions and debris from entering the draught hole 16 of the smoking device 22 and may also prevent the need for repeated cleaning of the smoking device 22. The filter member 10 may comprise plant-based materials 28 with different flavor profiles than that of the primary smoking material 24, signaling to a user that the primary smoking material 24 has neared complete combustion.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. An article for use with a smoking device, the article comprising:

a filter member configured to be insertable into a chamber defined in the smoking device, the filter member composed of at least one combustible plant-based material and an organic distillate material compressed into an air-permeable geometric shape, wherein the filter member has a first face, a second face opposed to the first face and at least one wall surface interposed between the first face and the second face and wherein the at least one combustible plant-based material includes at least one of hemp, marijuana, sage, *salvia* divinorum.

2. The article of claim 1 wherein the chamber defined in the smoking device includes an inner wall surface, at least one open end defined in the inner wall surface and at least one draught hole defined in the inner wall surface at a location opposed to the at least one open end, wherein the filter member is configured to contact the inner wall surface and to be positioned between the at least one open end and the draught hole in spaced relation to both.

3. The article of claim 1 wherein the at least one combustible plant-based material contains synthetic cannabinoids.

4. The article of claim 1 wherein the at least one combustible plant-based material further includes tobacco.

5. The article of claim 1 wherein the at least one organic distillate comprises CBD oil.

6. The article of claim 1 wherein the filter member weighs less than 1 gram.

7. The article of claim 1, wherein at least one of the first face of the filter member and the second face of the filter member is concave.

8. The article of claim 7 wherein the wall surface of the filter member has a height less than 10 millimeter.

9. The article of claim 1 wherein the filter member is cylindrical and has a diameter between 5 and 100 millimeters.

10. The article of claim 1 wherein the filter member further comprises at least one primary smoking material, the primary smoking material overlying and connected to a portion of the first face and connected thereto.

11. A smoking device comprising:

a bowl, the bowl having an inner chamber defined by a wall member, the wall member having at least at least one opening and at least one draught hole defined therein;

a mouthpiece in fluid communication with the at least one draught hole defined in the bowl;

a filter member, insertably positioned in the bowl at a location between the at least one opening and the draught hole in spaced relationship thereto, the filter member having at least one combustible plant-based material, wherein the filter member has a first face, a second face opposed to the first face and at least one wall member interposed between the first face and the second face, the filter member including combustible plant-based material compressed into an air-permeable geometric shape, wherein the at least one combustible plant-based material is at least one of hemp, marijuana, sage, *salvia* divinorum; and a primary smoking material positioned in the inner chamber defined by the wall member at a position overlaying the first face of the of the filter member and interposed between the opening defined in the bowl and the first face of the filter member, wherein the second face of the filter member and wall member of the bowl define an air pocket and wherein the draught hole communicates with the air pocket.

12. The smoking device of claim 11, wherein the smoking device is one of a pipe, a chillum pipe, a water pipe, a hookah, or a smoking apparatus with a detachable bowl.

13. The smoking device of claim 11, wherein the filter member is discs-shaped and has a diameter between 5 millimeters and 100 millimeters.

14. The smoking device of claim 13, wherein at least one of the first face or the second face of the filter member has a concave surface.

15. The smoking device of claim 11, wherein the combustible plant-based material further includes tobacco.

16. The smoking device of claim 15, wherein the combustible plant-based material further comprises synthetic cannabinoids.

17. The smoking device of claim 11 wherein the filter member further comprises a distillate selected from the group consisting of CBD oil.

18. The smoking device of claim 11 wherein the combustible plant-based material is formed by compacting the plant-based material in a hand-rosin press or mechanical press.

19. The smoking device of claim 11 wherein the filter member is less than 10 grams.

* * * * *